US011673407B2

(12) United States Patent
Takezawa

(10) Patent No.: US 11,673,407 B2
(45) Date of Patent: Jun. 13, 2023

(54) HEAD UNIT AND INKJET RECORDING APPARATUS HAVING THE SAME

(71) Applicant: KYOCERA Document Solutions Inc., Osaka (JP)

(72) Inventor: Mashio Takezawa, Osaka (JP)

(73) Assignee: KYOCERA DOCUMENT SOLUTIONS INC., Osaka (JP)

( * ) Notice: Subject to any disclaimer, the term of this patent is extended or adjusted under 35 U.S.C. 154(b) by 0 days.

(21) Appl. No.: 17/586,992

(22) Filed: Jan. 28, 2022

(65) Prior Publication Data

US 2022/0250390 A1 Aug. 11, 2022

(30) Foreign Application Priority Data

Feb. 8, 2021 (JP) ..... JP2021-018061

(51) Int. Cl.
*B41J 2/175* (2006.01)

(52) U.S. Cl.
CPC ..... *B41J 2/17596* (2013.01)

(58) Field of Classification Search
CPC .... B41J 2/165; B41J 2/16552; B41J 2/17566; B41J 29/17; B41J 2/17596; B41J 2/17523; B41J 2/1754; B41J 2/17553; B41J 2002/17579; B41J 2/16508; B41J 2002/16594; B41J 2/16535
See application file for complete search history.

(56) References Cited

U.S. PATENT DOCUMENTS 8,651,130 B2 * 2/2014 Ender ..... B41J 2/17596 222/94
10,752,003 B2 * 8/2020 Mizutani ..... B41J 2/17509
11,117,379 B2 * 9/2021 Fukasawa ..... B41J 2/17509

FOREIGN PATENT DOCUMENTS

JP 2002-036586 2/2002
JP 2006-068994 3/2006

* cited by examiner

*Primary Examiner* — An H Do
(74) *Attorney, Agent, or Firm* — Lex IP Meister, PLLC

(57) ABSTRACT

A head unit includes a common flow path, one or more recording heads, and a joint mechanism. The common flow path includes a liquid supply path through which one or more types of liquid including ink pass. The recording head is attachable to and detachable from the common flow path and has nozzles that discharge ink. The joint mechanism connects the liquid supply path and the liquid supply port of the recording head. The joint mechanism includes a first on-off valve and a coupling member. The first on-off valve is fixed to the common flow path and opens/closes the liquid supply path. The coupling member couples the first on-off valve and the liquid supply port. The coupling member is movable between a coupling position where the coupling member is coupled to the first on-off valve and a retracted position where the coupling member is retracted from the coupling position.

8 Claims, 16 Drawing Sheets

HEAD UNIT AND INKJET RECORDING APPARATUS HAVING THE SAME

INCORPORATION BY REFERENCE

This application is based upon and claims the benefit of priority from the corresponding Japanese Patent Application No. 2021-018061 filed on Feb. 8, 2021, the entire contents of which are incorporated herein by reference.

The present disclosure relates to a head unit mounted on an inkjet recording apparatus and the inkjet recording apparatus including the head unit, and particularly relates to a structure for attaching a recording head to the head unit.

BACKGROUND

Conventionally, in an inkjet recording apparatus such as an inkjet printer, ink is discharged from an ink discharge nozzle provided in a recording head, and the discharged ink adheres to a recording medium such as paper to form dots. In the above-described inkjet recording apparatus, it may be difficult to discharge ink from some ink discharge nozzles due to clogging or the like. In such a case, the recording head needs to be replaced.

In a so-called line head type printer in which recording heads are arranged so that ink discharge nozzles are arranged in an entire region in the width direction of a recording medium, for example, if three recording heads per color are unitized, it is relatively easy to replace the entire head unit. This is because the flow paths of liquid such as ink and cleaning liquid are completed in one head unit.

However, since only one recording head fails in the head unit in most cases, replacement of the entire head unit results in extra cost. Therefore, it is desirable to replace only the failed recording head. However, in a case where only one recording head is replaced, it is necessary to block the flow path of the liquid, and there is a concern of liquid leakage during replacement.

As a method of avoiding liquid leakage during replacement of a recording head, for example, in an inkjet printer that detachably holds a cartridge holding an ink tank containing ink, an inkjet recording apparatus is known that avoids liquid leakage of ink at the time of maintenance such as head replacement by increasing negative pressure of the ink tank by a negative pressure increasing mechanism and stopping the increase of negative pressure by the negative pressure increasing mechanism when the inkjet printer is attached to the printer. In this method, it is necessary to provide a negative pressure increasing mechanism in the head cartridge, which leads to a complicated configuration and an increase in cost. In addition, in the configuration of Patent Document 1, the ink tank is disposed in the head cartridge, but this configuration cannot be applied to a configuration in which the ink tank is disposed separately from the recording head.

An inkjet recording apparatus is known, having a configuration which includes an on-off valve which opens and closes the ink supply path on the carriage loading thereon a recording head, and which, by operating the head fixing lever to leverage the lever attached to the head fixing lever, opens the on-off valve in the state in which the recording head is connected to the carriage and closes the on-off valve when the recording head is separated. In this stated configuration, the opening and closing of the supply valve is not performed unless the head fixing lever is operated, so that there is a possibility of forgetting to operate the head fixing lever or ink leakage during a time until the operation of the head fixing lever is completed.

SUMMARY

A first configuration of the present disclosure is a head unit that includes a common flow path, one or more recording heads, and a joint mechanism, is mounted on an inkjet recording apparatus, and performs image recording on a recording medium. The common flow path includes a liquid supply path through which one or more types of liquid including ink pass. The recording head is attachable to and detachable from the common flow path and has nozzles that discharge ink. The joint mechanism connects the liquid supply path and the liquid supply port of the recording head. The joint mechanism includes a first on-off valve and a coupling member. The first on-off valve is fixed to the common flow path and opens/closes the liquid supply path. The coupling member couples the first on-off valve and the liquid supply port. The coupling member is movable between a coupling position where the coupling member is coupled to the first on-off valve and a retracted position where the coupling member is retracted from the coupling position. When the coupling member is positioned in the retracted position, a clearance is formed between the first on-off valve and the coupling member.

This Summary is provided to introduce a selection of concepts in a simplified form that are further described below in the Detailed Description with reference where appropriate to the accompanying drawings. This Summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

DETAILED DESCRIPTION

[1. Configuration of Inkjet Recording Apparatus]

Figure 1:
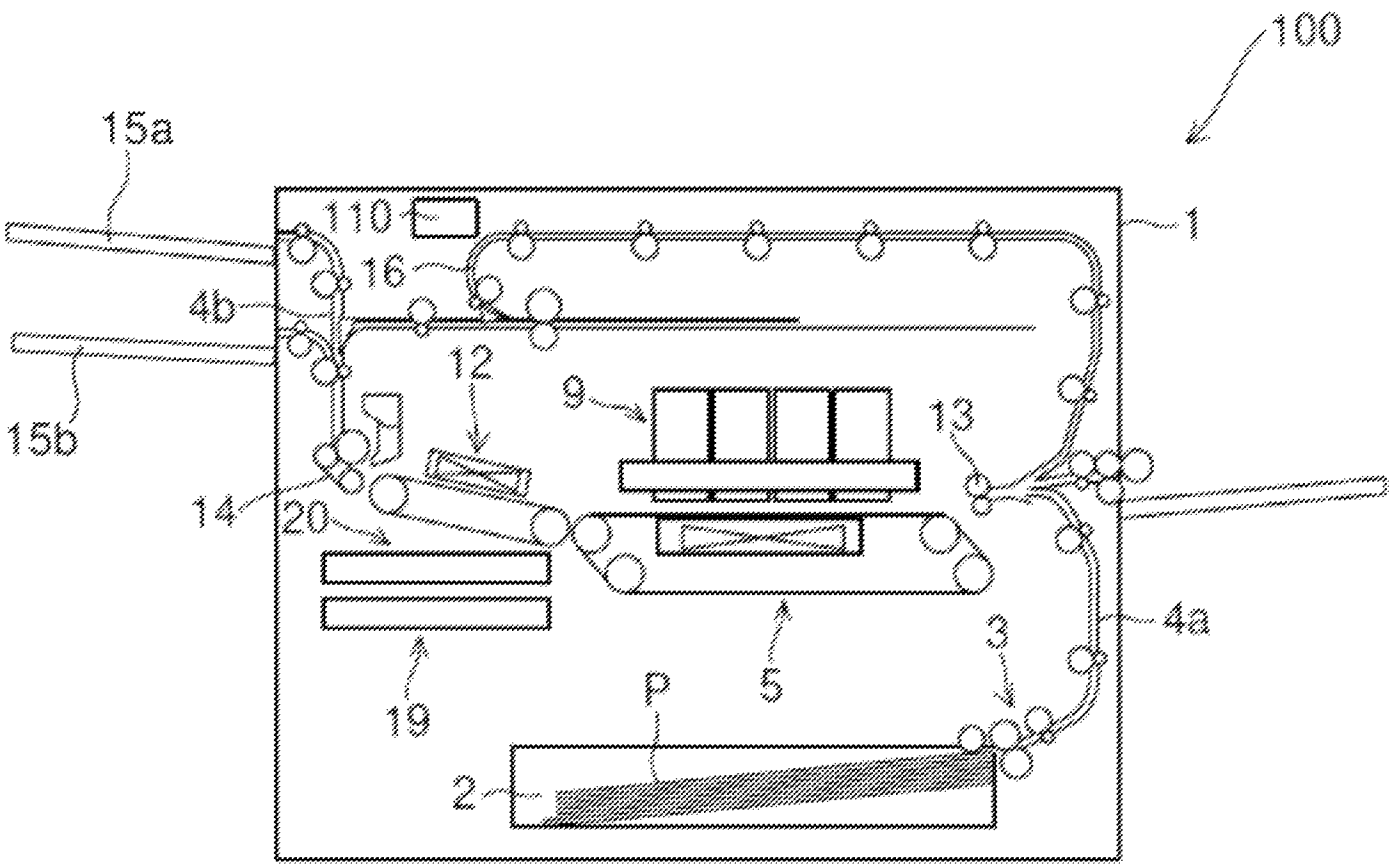
FIG. 1 is an explanatory diagram illustrating a schematic configuration of a printer 100 as an inkjet recording apparatus according to an embodiment of the present disclosure.

Hereinafter, embodiments of the present disclosure will be described with reference to the drawings. FIG. 1 is an explanatory diagram illustrating a schematic configuration of a printer 100 as an inkjet recording apparatus according to an embodiment of the present disclosure. The printer 100 includes a sheet feed cassette 2 serving as a paper storage unit. The sheet feed cassette 2 is disposed at a lower portion inside a printer main body 1. Sheets P, which are an example of recording media, are accommodated inside the sheet feed cassette 2.

A sheet feeder 3 is disposed on a downstream side of the sheet feed cassette 2 in the sheet conveyance direction, i.e., on the upper right side of the sheet feed cassette 2 in FIG. 1. The sheet feeder 3 separates and feeds the sheets P one by one toward the upper right of the sheet feed cassette 2 in FIG. 1.

The printer 100 includes therein a first sheet conveyance path 4*a*. The first sheet conveyance path 4*a* is located on the upper right side of the sheet feed cassette 2 in a sheet feeding direction. The sheet P sent out from the sheet feed cassette 2 is conveyed vertically upward along the side surface of the printer main body 1 through the first sheet conveyance path 4*a*.

A registration roller pair 13 is provided at a downstream end of the first sheet conveyance path 4*a* in the sheet conveyance direction. Further, a first conveyance unit 5 and a recording unit 9 are disposed immediately downstream of the registration roller pair 13 in the sheet conveying direction. The sheet P fed from the sheet feed cassette 2 passes through the first sheet conveyance path 4*a* and reaches the registration roller pair 13. The registration roller pair 13 corrects skew feeding of the sheet P, and feeds the sheet P toward the first conveyance unit 5 (in particular, a first conveyance belt 8 to be described later) at the same timing as an ink discharge operation performed by the recording unit 9.

The sheet P fed to the first conveyance unit 5 by the registration roller pair 13 is conveyed to a position facing the recording unit 9 (in particular, a recording heads 17*a* to 17*c* described later) by the first conveyance belt 8. An image is recorded on the sheet P by ink being discharged from the recording unit 9 onto the sheet P. At this time, the discharge of ink in the recording unit 9 is controlled by the control device 110 inside the printer 100.

A second conveyance unit 12 is disposed on the downstream side (left side in FIG. 1) in the sheet conveyance direction. The sheet P on which an image has been recorded by the recording unit 9 is sent to the second conveyance unit 12. The ink discharged onto the surface of the sheet P is dried while passing through the second conveyance unit 12.

A decurler unit 14 is provided in the vicinity of the left side surface of the printer main body 1 on the downstream side of the second conveyance unit 12 in the sheet conveyance direction. The sheet P whose ink has been dried by the second conveyance unit 12 is sent to the decurler unit 14, and the curl that has occurred in the paper P is corrected.

A second sheet conveyance path 4*b* is provided on the downstream side of the decurler unit 14 (upper side in FIG. 1) in the sheet conveyance direction. In a case where double-sided recording is not performed, the sheet P that has passed through the decurler unit 14 passes through the second sheet conveyance path 4*b* and is discharged to a sheet discharge tray 15*a* provided outside the left side surface of the printer 100. Below the sheet discharge tray 15*a*, there is provided a sub discharge tray 15*b* for discharging unnecessary sheets P (damaged sheets) having a printing failure or the like.

A reverse conveyance path 16 for performing double-sided recording is provided above the recording unit 9 and the second conveyance unit 12 in the upper portion of the printer main body 1. In a case where double-sided recording is performed, the sheet P that has passed through the second conveyance unit 12 and the decurler unit 14 after recording on one surface (first surface) of the sheet P is completed is sent to the reverse conveyance path 16 through the second sheet conveyance path 4*b*.

The conveyance direction of the sheet P sent to the reverse conveyance path 16 is subsequently switched for recording on the other surface (second surface) of the sheet P. Then, the sheet P passes through the upper portion of the printer main body 1 and is sent toward the right side, and is sent again to the first conveyance unit 5 via the registration roller pair 13 in a state in which the second surface faces upward. In the first conveyance unit 5, the sheet P is conveyed to a position facing the recording unit 9, and an image is recorded on the second surface by ink discharge from the recording unit 9. The sheet P after double-sided recording passes through the second conveyance unit 12, the decurler unit 14, and the second sheet conveyance path 4*b* in this order, and is discharged to the sheet discharge tray 15*a*.

A maintenance unit 19 and a cap unit 20 are disposed below the second conveyance unit 12. The maintenance unit 19 moves horizontally below the recording unit 9 when purging is performed, wipes the ink pushed out from the ink discharge ports of the recording head, and collects the wiped ink. Note that purging refers to an operation of forcibly pushing out ink from an ink discharge port of a recording head in order to discharge thickened ink, foreign matter, and air bubbles in the ink discharge port. When capping the ink discharge surface of the recording head, the cap unit 20 is horizontally moved below the recording unit 9 and is further moved upward to be mounted on the lower surface of the recording head.

Figure 2:
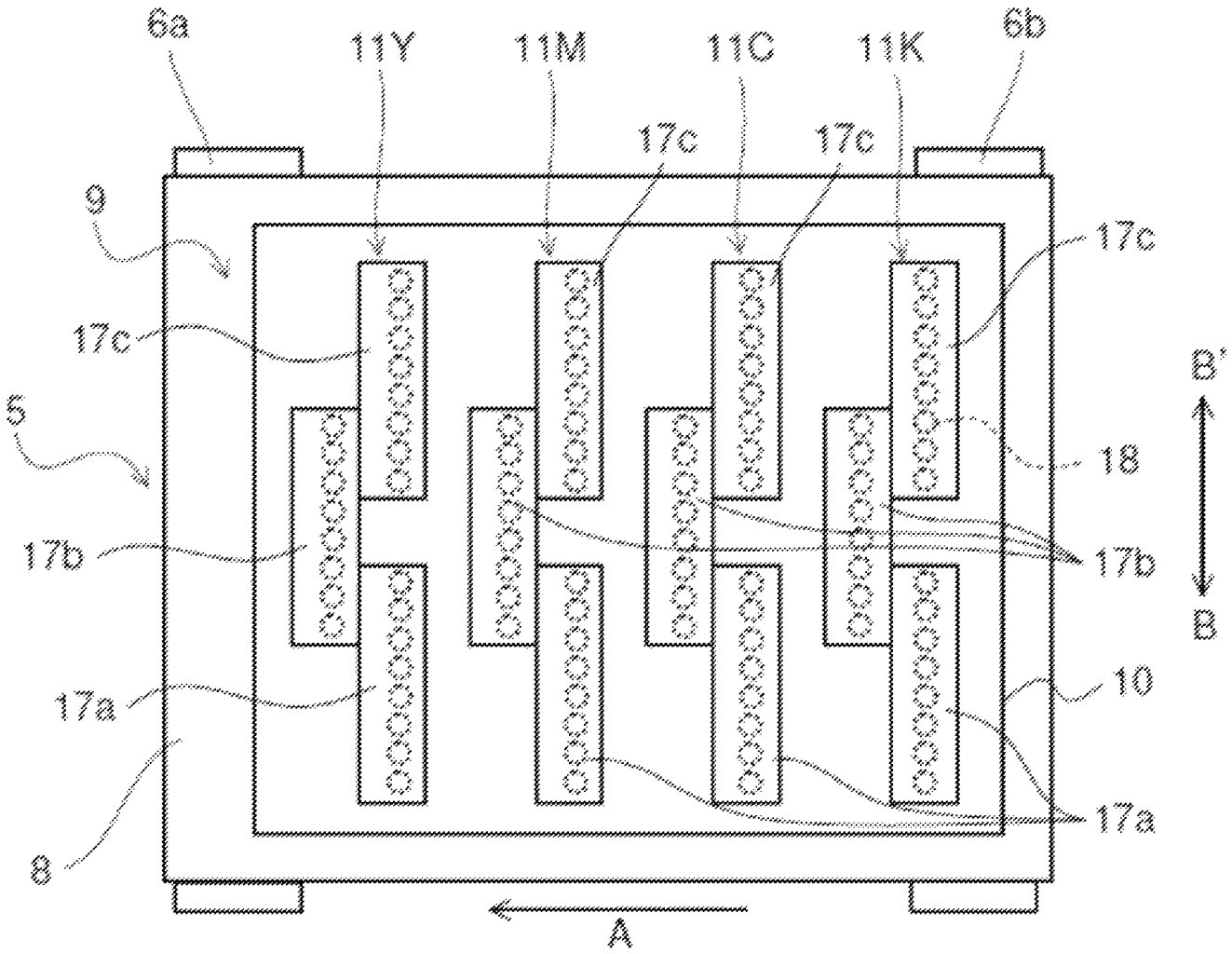
FIG. 2 shows a plan view of a recording unit 9 included in the printer 100.

FIG. 2 is a plan view of the recording unit 9. The recording unit 9 includes a head housing 10 and line heads 11Y, 11M, 11C, 11K. The line heads 11Y to 11K are held by the head housing 10 at a height at which a predetermined interval (for example, a 1 mm) is formed with respect to a conveyance surface of an endless first conveyance belt 8 stretched by a plurality of rollers including a drive roller 6*a*, a driven roller 6*b*, and a tension roller (not illustrated). The drive roller 6*a* causes the first conveyance belt 8 to travel in the conveyance direction of the paper P (the direction of arrow A).

The line heads 11Y to 11K include a plurality of (here, three) recording heads 17*a* to 17*c*. The recording heads 17*a* to 17*c* are arranged in a staggered manner along a paper width direction (arrow BB' direction) orthogonal to a sheet conveyance direction (arrow A direction). The recording heads 17*a* to 17*c* have ink discharge ports 18 (nozzles). The ink discharge ports 18 are arranged side by side at equal intervals in the width direction of the recording head, that is, in the sheet width direction (arrow BB' direction). From the line heads 11Y to 11K, inks of respective colors of yellow (Y), magenta (M), cyan (C), and black (K) are discharged toward the sheet P conveyed by the first conveyance belt 8, via the ink discharge ports 18 of the recording heads 17*a* to 17*c*.

Figure 3:
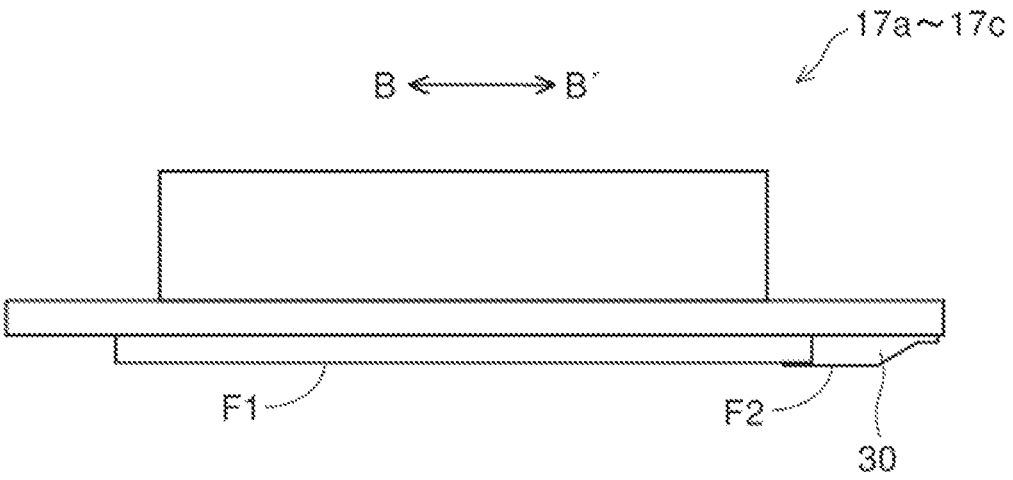
FIG. 3 is a side view of recording heads 17*a* to 17*c* of the recording unit 9, constituting line heads 11Y to 11K.
Figure 4:
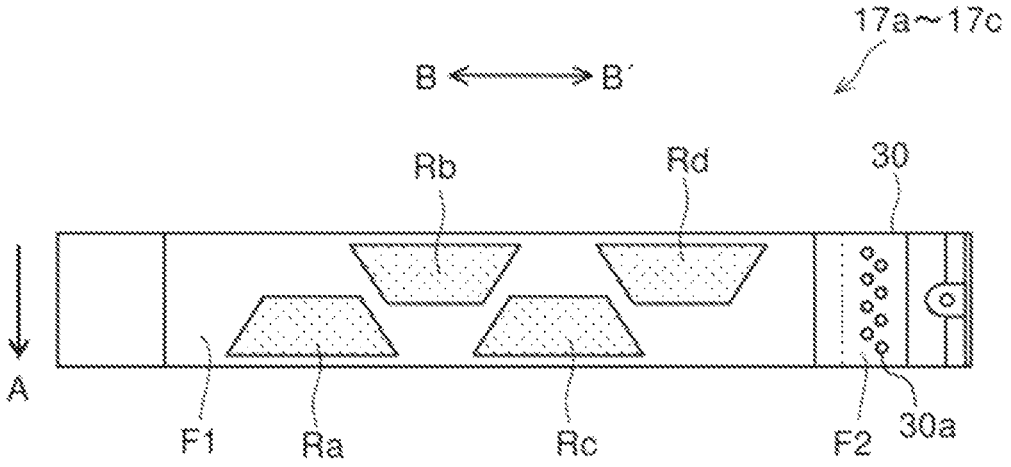
FIG. 4 is a plan view of the recording heads 17*a* to 17*c* viewed from a side of the ink discharge surface.

FIG. 3 is a side view of the recording heads 17*a* to 17*c* constituting the line heads 11Y to 11K of the recording unit 9, and FIG. 4 is a plan view of the recording heads 17*a* to 17*c* as viewed from the ink discharge surface F1 side. Since the recording heads 17*a* to 17*c* have the same shape and configuration, the recording heads 17*a* to 17*c* are illustrated as one drawing in FIGS. 3 and 4. As shown in FIGS. 3 and 4, nozzle regions (here, four blocks) Ra to Rd, in which a large number of ink discharge ports 18 (see FIG. 2) are arranged, are provided on an ink discharge surface (nozzle surface) F1 of the recording heads 17*a* to 17*c*. The ink discharge surface F1 is formed of stainless steel (SUS), for example.

Inks of four colors (cyan, magenta, yellow, and black) are supplied from a liquid supply mechanism 50 (see FIG. 5) to the recording heads 17*a* to 17*c* constituting each line heads 11C to 11K for each color of the line heads 11C to 11K.

In response to control signals from a control device 110 (see FIG. 1) and according to image data received from an external computer, the recording heads 17*a* to 17*c* discharge ink from ink discharge ports 18 toward the sheet P that is being conveyed while being held by suction on the conveyance surface of the first conveyance belt 8. As a result, a color image in which the inks of the four colors of cyan, magenta, yellow, and black are superimposed is formed on the sheet P on the first conveyance belt 8. In addition, a cleaning liquid supply unit 30 that supplies a cleaning liquid is provided at one end portion of the recording heads 17*a* to 17*c* in the longitudinal direction (arrow BB' direction) orthogonal to the sheet conveyance direction (arrow A direction). Cleaning liquid supply ports 30*a* are formed in the cleaning liquid supply unit 30.

To clean the ink discharge surface F1 of the recording heads 17*a* to 17*c*, the printer 100 performs an operation to recover the recording heads 17*a* to 17*c* to push out (purges) ink from the ink discharge ports 18 of all the recording heads 17*a* to 17*c* at the start of printing after a long-term stop and between printing operations, supply cleaning liquid from the cleaning liquid supply port 30*a* to a cleaning liquid supply surface F2, and wipe off the ink discharged to the ink discharge surface F1 together with the cleaning liquid by a wiper (not shown), thereby preparing for a next printing operation. The ink and the cleaning liquid wiped from the ink discharge surface F1 are collected by an ink receiving portion (not shown).

Figure 5:
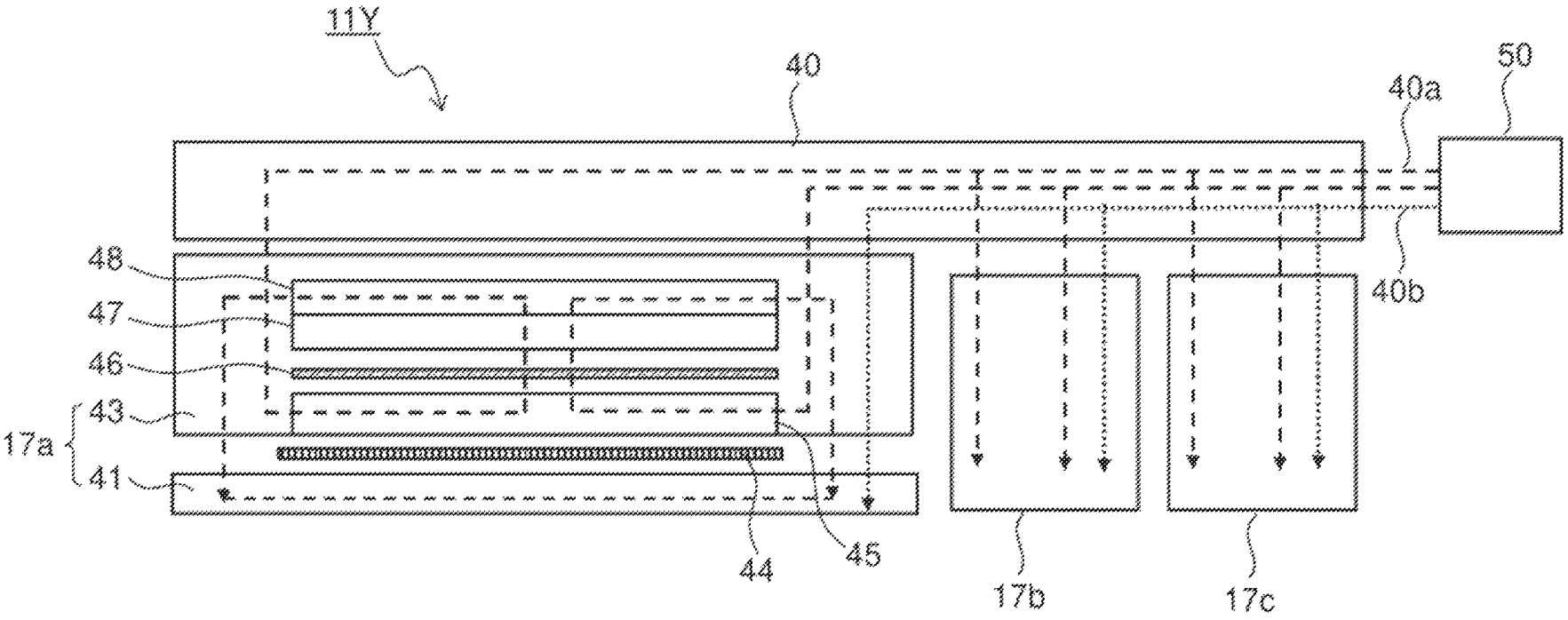
FIG. 5 is a diagram schematically illustrating internal structures of an ink supply path 40*a*, a cleaning liquid supply path 40*b*, and recording heads 17*a* to 17*c* that constitute the line head 11Y of the printer 100.

FIG. 5 is a schematic diagram showing internal structures of an ink supply path 40*a*, a cleaning liquid supply path 40*b* and recording heads 17*a* to 17*c* constituting the line heads 11Y of the printer 100. Since the line heads 11M to 11K have the same configuration, the description thereof will be omitted. Further, since the internal structures of the recording heads 17*a* to 17*c* of the recording head are the same, only an internal structure of the recording head 17*a* is shown in FIG. 5.

As shown in FIG. 5, a common flow path 40 through which ink and cleaning liquid pass is connected to the recording heads 17*a* to 17*c*. In the common flow path 40, two ink supply paths 40*a* through which ink passes and one cleaning liquid supply path 40*b* through which cleaning liquid passes are formed. Upstream ends of the ink supply path 40*a* and the cleaning liquid supply path 40*b* are connected to the liquid supply mechanism 50. The liquid supply mechanism 50 is constituted by a tank that stores the ink and the cleaning liquid, and a pump that pumps up the ink and the cleaning liquid from the tank (both not shown).

Two ink supply paths 40*a* are each branched into three paths at a downstream end, that is, six paths in total, and two paths are connected to each of the ink discharge ports 18 of the recording heads 17*a* to 17*c*. The cleaning liquid supply path 40*b* branches into three paths at the downstream end and is connected to a cleaning liquid supply unit 30 (see FIGS. 3 and 4) of the recording heads 17*a* to 17*c*. Hereinafter, a unit including the recording heads 17*a* to 17*c* and the common flow path 40 is referred to as a head unit 51 (see FIG. 6).

The recording heads 17*a* to 17*c* include a head front portion 41, a head rear portion 43, and a heater 44. The head front portion 41 is provided with an ink discharge surface F1 on which a large number of ink discharge ports 18 are arranged, and a cleaning liquid supply unit 30 that supplies a cleaning liquid (see FIG. 4).

The head rear portion 43 includes an ink heating flow path 45, a filter 46, a reservoir tank 47, and a damper 48. The ink supply path 40*a* is connected to the ink heating flow path 45, the filter 46, the reservoir tank 47, and the damper 48, and is then connected to the ink discharge port 18 of the head front portion 41.

A heater 44 is disposed between the head front portion 41 and the head rear portion 43. The heater 44 heats the ink in the ink heating flow path 45, which will be described later, to a predetermined temperature as necessary, and heats the head front portion 41 so that the ink can be smoothly discharged from the ink discharge ports 18.

The ink heating flow path 45 heats the ink in the ink supply path 40*a* to a predetermined temperature. The ink heating flow path 45 is provided at a position adjacent to the heater 49 in the head rear portion 43. The filter 46 removes foreign matter from the ink passing through the ink supply path 40*a*. The reservoir tank 47 temporarily stores ink passing through the ink supply path 40*a*. The damper 48 is formed of a resin film having flexibility, and ink is pushed out to the head front portion 41 by pulsating the damper 48.

One of the two ink supply paths 40*a* is used for supplying ink from the liquid supply mechanism 50 to the recording heads 17*a* to 17*c*, and the other is used for collecting ink from the recording heads 17*a* to 17*c* to the liquid supply mechanism 50. When an image having a large ink discharge amount is recorded, both of the two ink supply paths 40*a* can be used for supplying ink to the recording heads 17*a* to 17*c*.

Figure 6:
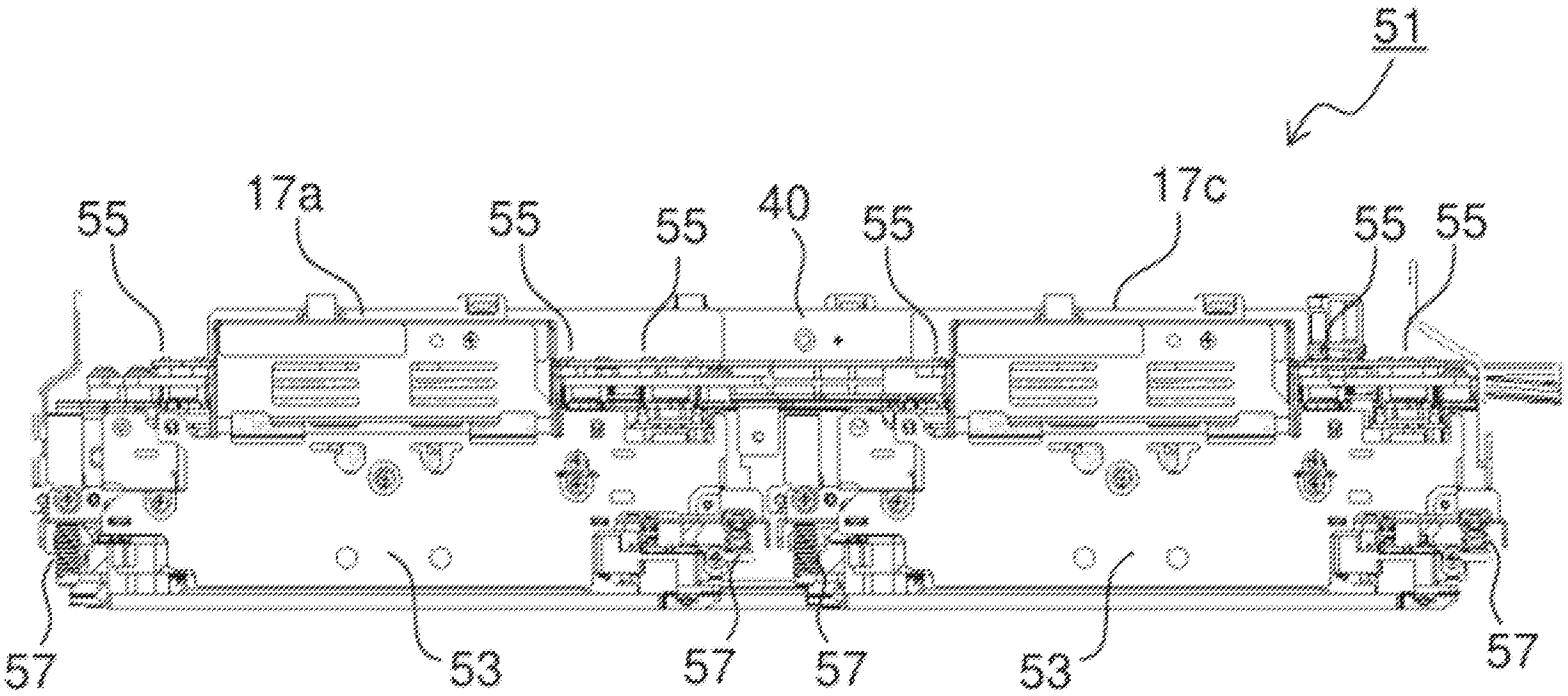
FIG. 6 is a side view of a head unit 51 as viewed from the upstream side in the sheet conveyance direction.
Figure 7:
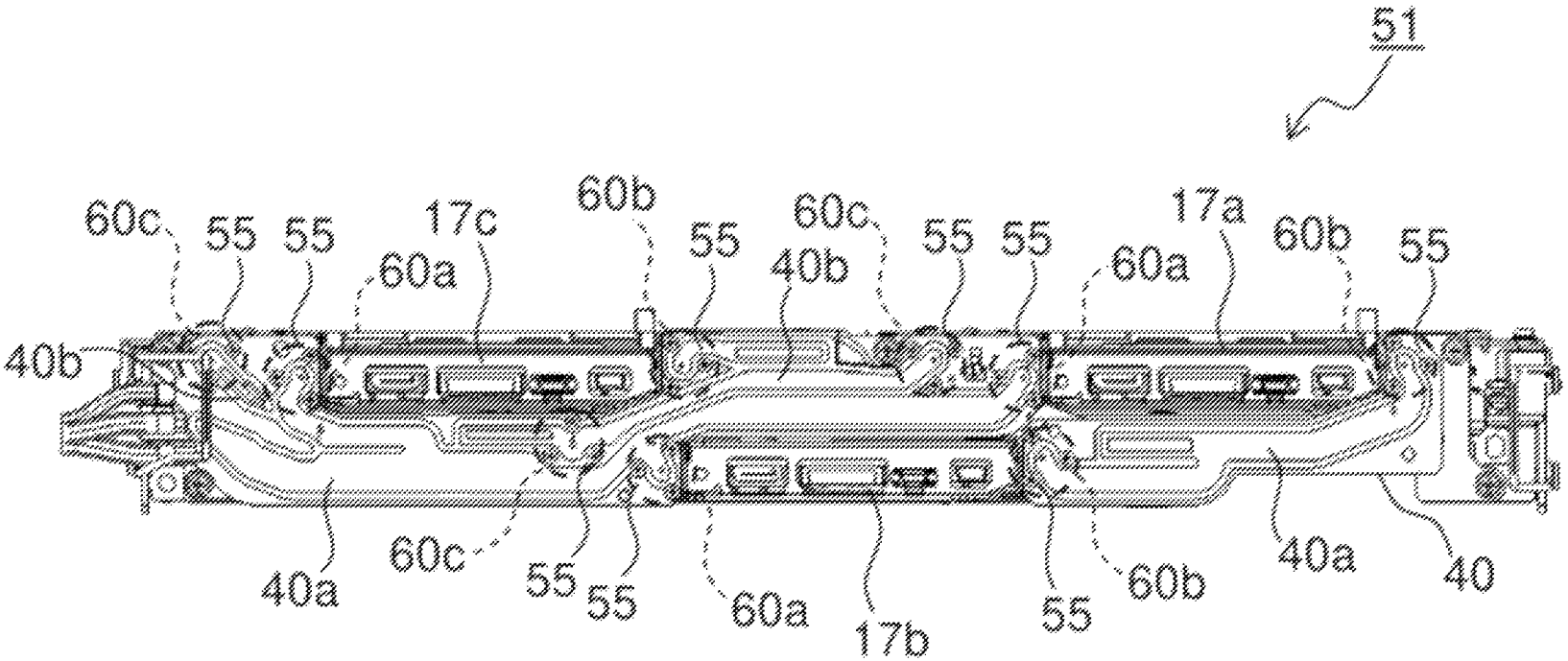
FIG. 7 is a plan view of the head unit 51 as viewed from above.
Figure 8:
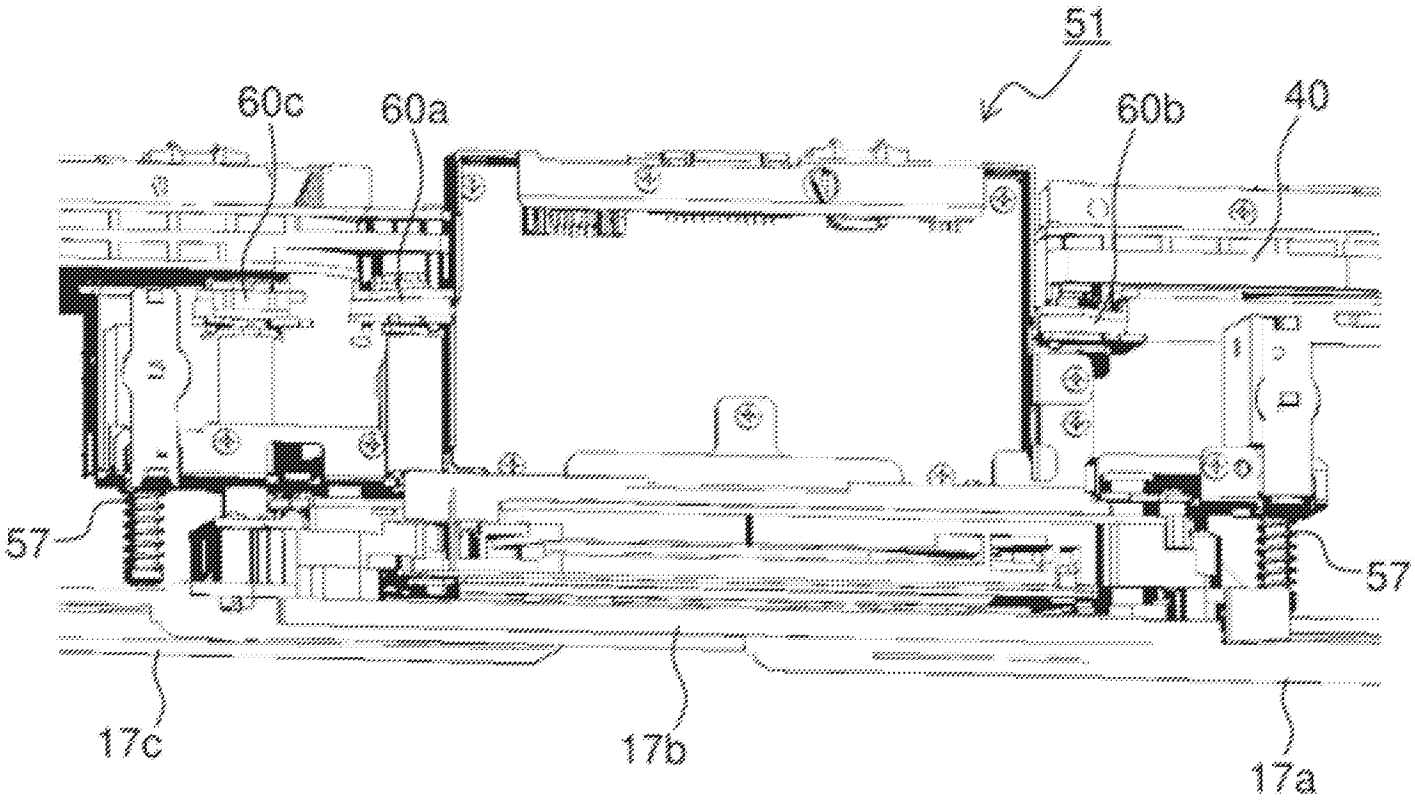
FIG. 8 is a partial enlarged view of the vicinity of the recording head 17*b* of the head unit 51.

FIG. 6 is a side view of the head unit 51 as viewed from the upstream side in the sheet conveying direction (the right side in FIG. 2). FIG. 7 is a plan view of the head unit 51 as viewed from above. FIG. 8 is a partially enlarged view of the vicinity of the recording head 17*b* of the head unit 51. The recording heads 17*a* to 17*c* can be individually attached to and detached from the common flow path 40. More specifically, three joint mechanisms 60*a* to 60*c* that connect each recording head 17*a* to 17*c* and the common flow path 40 are fastened from above the common flow path 40 by three first fixing screws 55 (nine in total) per joint mechanism. Further, both left and right end portions of each recording head 17*a* to 17*c* are fastened to the common flow path 40 by second fixing screws 57. A heat sink 53 is mounted on the side surface of the of each recording head 17*a* to 17*c*. The heat sink 53 radiates heat generated from a flexible substrate (not shown) disposed inside.

Each of the joint mechanisms 60*a* and 60*b* is connected to two ink supply paths 40*a* (see FIG. 7). The joint mechanism 60*c* is connected to the cleaning liquid supply path 40*b*.

[2. Configuration of Joint Mechanism]

Figure 9:
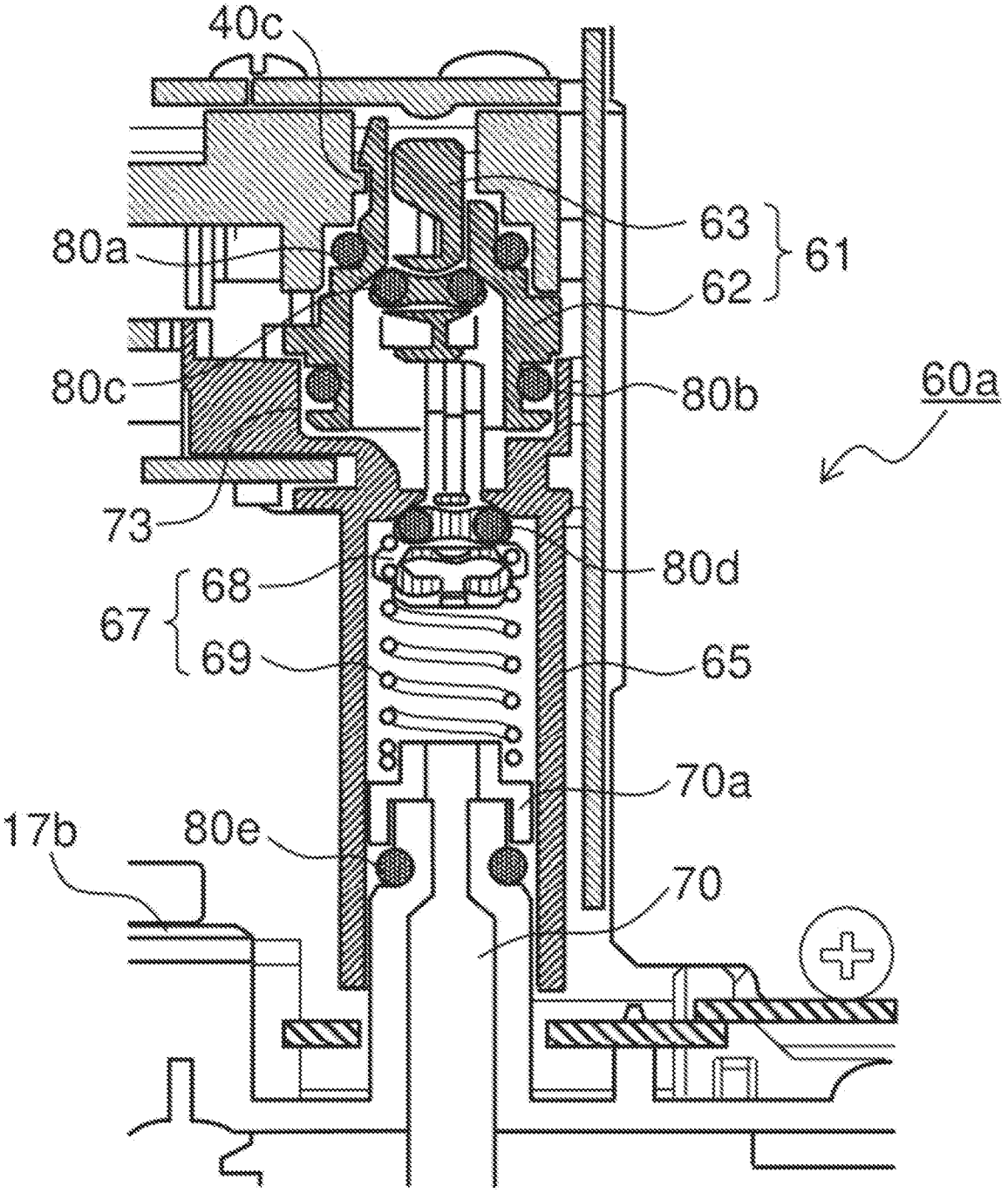
FIG. 9 is a side cross-sectional view of a joint mechanism 60*a* of the recording head 17*b*.
Figure 10:
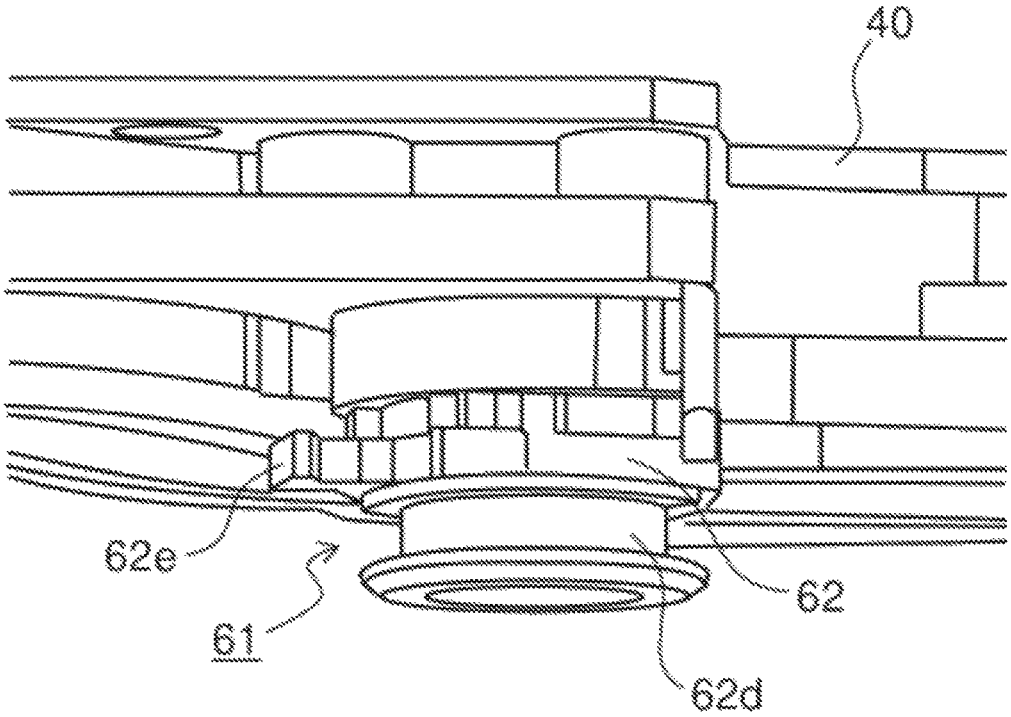
FIG. 10 is a perspective view showing a state in which a first on-off valve 61 is attached to a common flow path 40.
Figure 11:
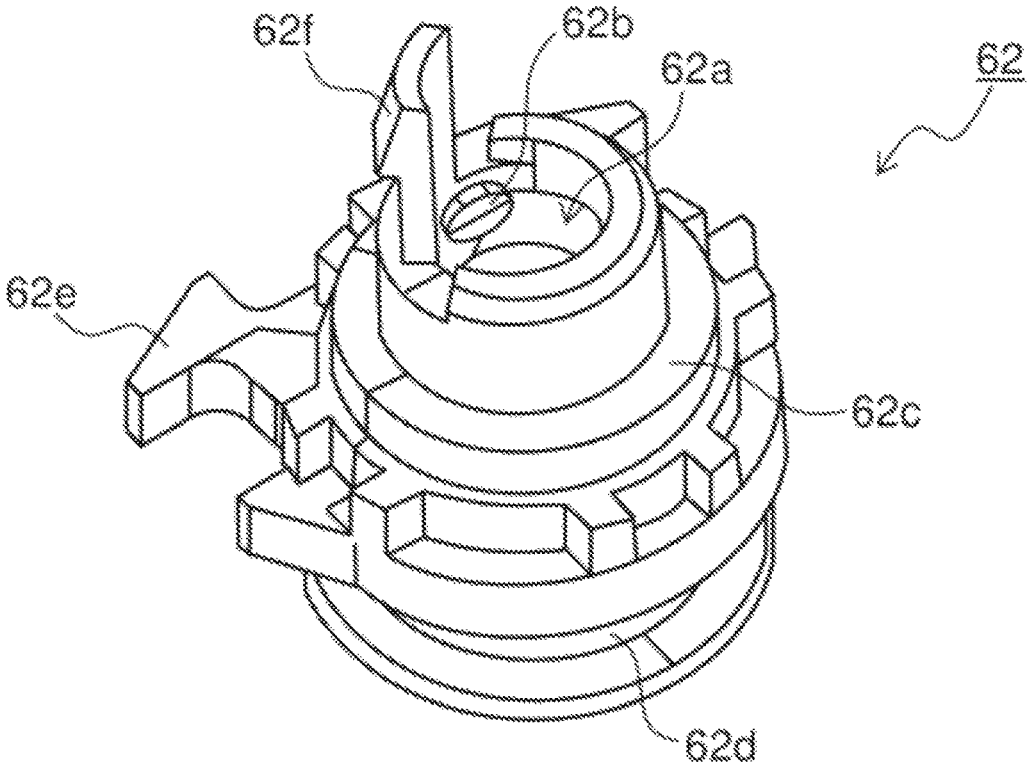
FIG. 11 is a perspective view of the switching member 62 constituting the first on-off valve 61.
Figure 12:
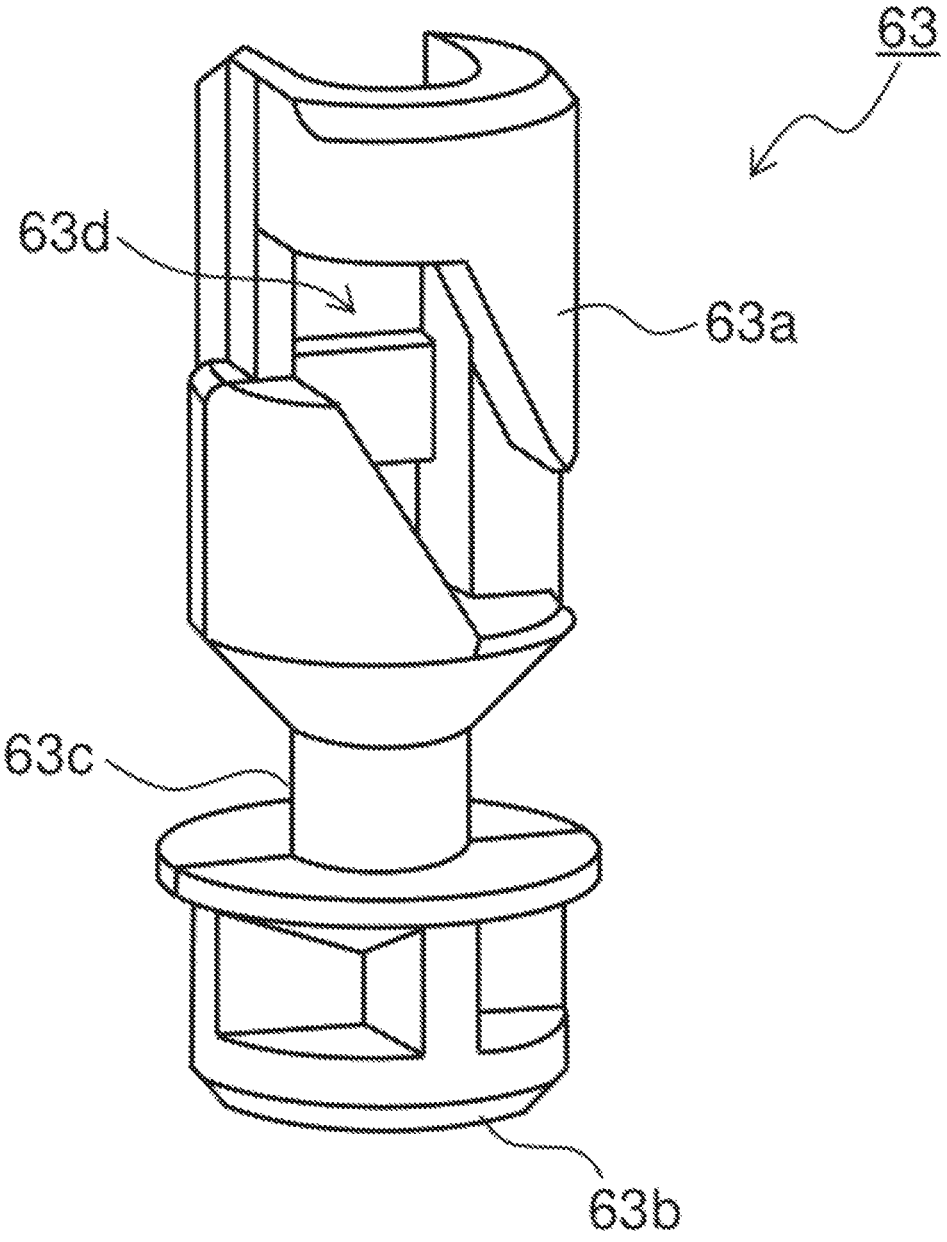
FIG. 12 is a perspective view of a first opening/closing member 63 constituting the first on-off valve 61.
Figure 13:
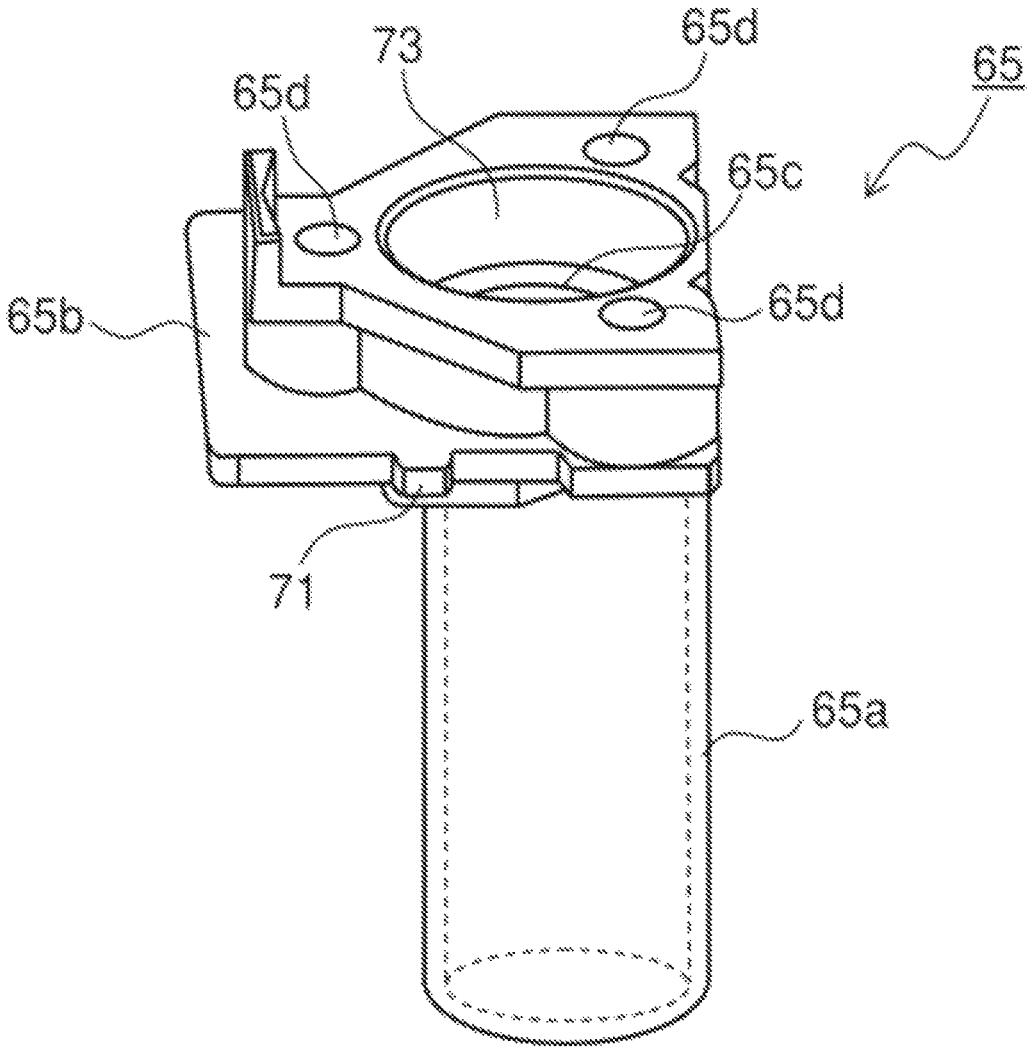
FIG. 13 is a perspective view of a coupling member 65.

Hereinafter, detailed configuration of the joint mechanisms 60*a* to 60*c* will be described. FIG. 9 is a side cross-sectional view of the joint mechanism 60*a* of the recording head 17*b*. FIG. 10 is a perspective view showing a state in which a first on-off valve 61 is attached to the common flow path 40. FIG. 11 is a perspective view of a switching member 62 constituting the first on-off valve 61. FIG. 12 is a perspective view of a first opening/closing member 63 constituting the first on-off valve 61. FIG. 13 is a perspective view of a coupling member 65. Although the configuration of the joint mechanism 60*a* of the recording head 17*b* is illustrated here, the joint mechanisms 60*b*, 60*c* have the same configuration as that of the joint mechanism 60*a*. The joint mechanisms 60*a* to 60*c* of the recording heads 17*a* to 17*c* have the same configuration, too.

As shown in FIG. 9, the joint mechanism 60*a* includes the first on-off valve 61, a coupling member 65, and a second on-off valve 67. The first on-off valve 61 is attached to the ends of the ink supply path 40*a* and the cleaning liquid supply path 40*b* (see FIG. 7) of the common flow path 40. The first on-off valve 61 includes the switching member 62 and the first opening/closing member 63.

As shown in FIG. 11, the switching member 62 has a substantially hollow cylindrical shape whose diameters gradually decrease upward and has an insertion hole 62*a* into which the first opening/closing member 63 is inserted. An engagement boss 62*b* is provided on an inner peripheral surface of the insertion hole 62*a* so as to protrude. A first flange portion 62*c*, a second flange portion 62*d*, and a lever portion 62*e* are formed on an outer peripheral surface of the switching member 62. A first O-ring 80*a* (see FIG. 9) for sealing a clearance between the common flow path 40 and the switching member 62 is mounted on the first flange portion 62*c*. A second O-ring 80*b* (see FIG. 9) for sealing a clearance between the first on-off valve 61 and the coupling member 65 is mounted on the second flange portion 62*d*. The lever portion 62*e* is pressed in the circumferential direction when the switching member 62 is rotated to open and close the first on-off valve 61.

An engaging claw 62*f* is formed at an upper end portion of the switching member 62. The engaging claw 62*f* engages with an engaged portion 40*c* (see FIG. 9) in the common flow path 40, thereby preventing the switching member 62 from falling in a state in which the recording heads 17*a* to 17*c* are removed as shown in FIG. 10.

As shown in FIG. 12, the first opening/closing member 63 has a sliding portion 63*a*, a pressing portion 63*b*, and a small-diameter portion 63*c*. The sliding portion 63*a* has a substantially cylindrical shape and is inserted into the insertion hole 62*a* of the switching member 62 so as to be slidable in the vertical direction. An engagement groove 63*d* is formed on the outer surface of the sliding portion 63*a*. The engagement groove 63*d* is formed so as to be inclined with respect to the axial direction (vertical direction) of the sliding portion 63*a*, and the engagement boss 62*b* (see FIG. 11) of the switching member 62 engages therewith.

Figure 14:
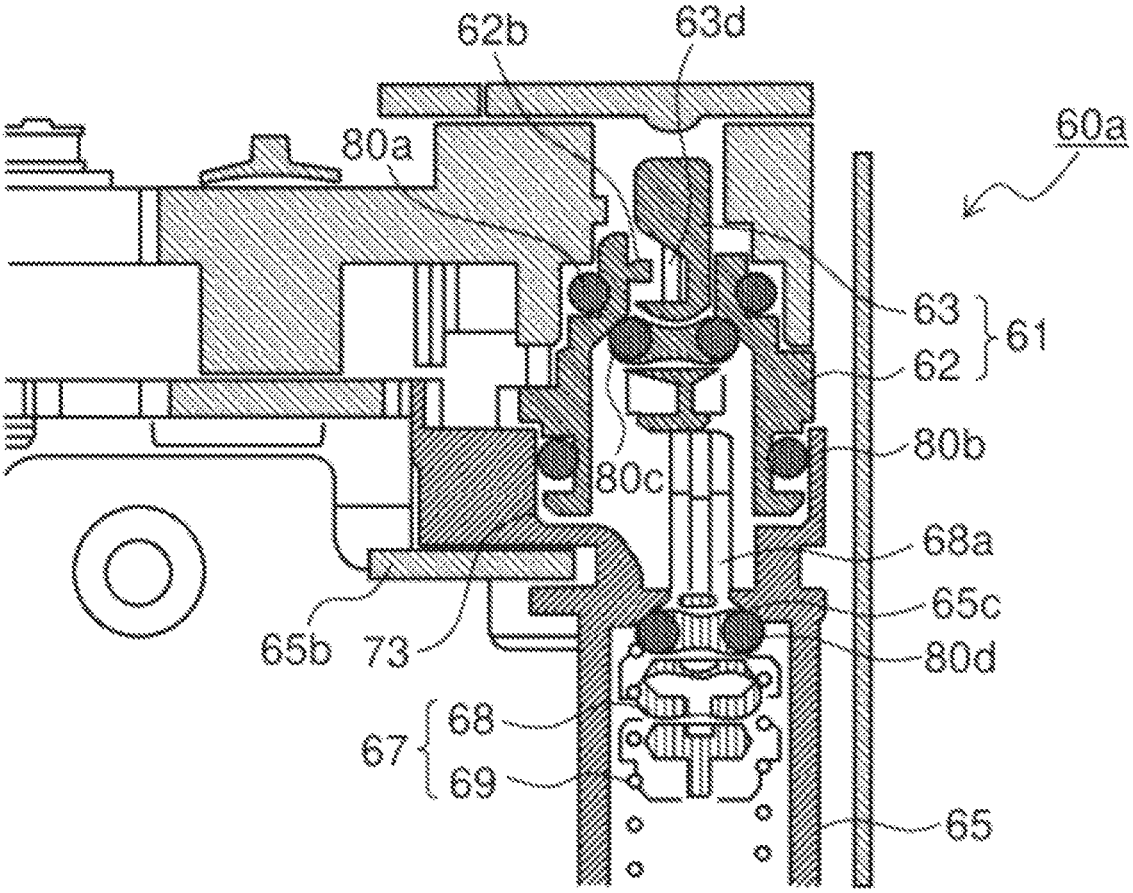
FIG. 14 is a side cross-sectional view of the joint mechanism 60*a*, showing a state in which the first on-off valve 61 and a second on-off valve 67 are closed.

The pressing portion 63*b* is provided at a lower end portion of the first opening/closing member 63 and comes into contact with a tip end portion 68*a* of a second opening/closing member 68 (see FIG. 14). The small-diameter portion 63*c* is formed between the sliding portion 63*a* and the pressing portion 63*b*, and a third O-ring 80*c* (see FIG. 9, a first sealing member) is attached thereto, which comes into contact with the inner surface of the insertion hole 62*a* of the switching member 62 when the first on-off valve 61 is closed.

As shown in FIG. 13, the coupling member 65 has a hollow cylindrical main body portion 65*a* whose upper end portion and lower end portion are open, and a support plate 65*b* that is fixed in the vicinity of the upper end portion of the main body portion 65*a* in a horizontal direction orthogonal to the axial direction. An upper end portion of the main body portion 65*a* is connected to a first on-off valve 61 (see FIG. 9). A lower end portion of the main body portion 65*a* is connected to an ink supply port 70 (see FIG. 9) of the recording head 17*b*.

A liquid passage port 65*c* is formed in the vicinity of an upper end portion of a main body portion 65*a*. The second on-off valve 67 (see FIG. 9) is disposed inside the main body portion 65*a*. The second on-off valve 67 includes the second opening/closing member 68 and a coil spring 69 that urges the second opening/closing member 68 upward. The inner diameter of the liquid passage port 65*c* is smaller than those of other portions of the main body portion 65*a*, and the second opening/closing member 68 is pressed against the liquid passage port 65*c* by the urging force of the coil spring 69, thereby closing the ink flow path in the coupling member 65. A fourth O-ring 80*d* (see FIG. 9, second sealing member) that comes into contact with the peripheral edge portion of the liquid passage port 65*c* is attached to the second opening/closing member 68.

The tip end portion 68*a* of the second opening/closing member 68 protrudes upward from the liquid passage port 65*c* of the coupling member 65 and is in contact with the pressing portion 63*b* of the first opening/closing member 63. A lower end portion of the coil spring 69 is fixed to a spring receiving portion 70*a* formed in an ink supply port 70 of the recording head 17*b*. A fifth O-ring 80*e* (see FIG. 9) for sealing a clearance between the coupling member 65 and the ink supply port 70 is attached to the ink supply port 70.

Screw holes 65*d* to which the first fixing screws 55 are fastened are formed at three locations on the upper surface of the main body portion 65*a*. By fastening the first fixing screw 55 to the screw hole 65*d*, as shown in FIG. 9, the coupling member 65 is fixed at a position (coupling position) where the coupling member 65 is connected to the first on-off valve 61.

A liquid storage portion 73 is formed between the upper surface of the main body portion 65*a* and the liquid passage port 65*c*. As shown in FIG. 9, the liquid storage portion 73 has a large diameter compared to the lower side of the liquid passage port 65*c* and has a volume equal to or larger than a space between the first on-off valve 61 and the second on-off valve 67. A protrusion 71 is formed at the side end of the support plate 65*b*. The protrusion 71 protrudes outward from an opening 53*a* (see FIG. 16) of the heat sink 53.

Figure 15:
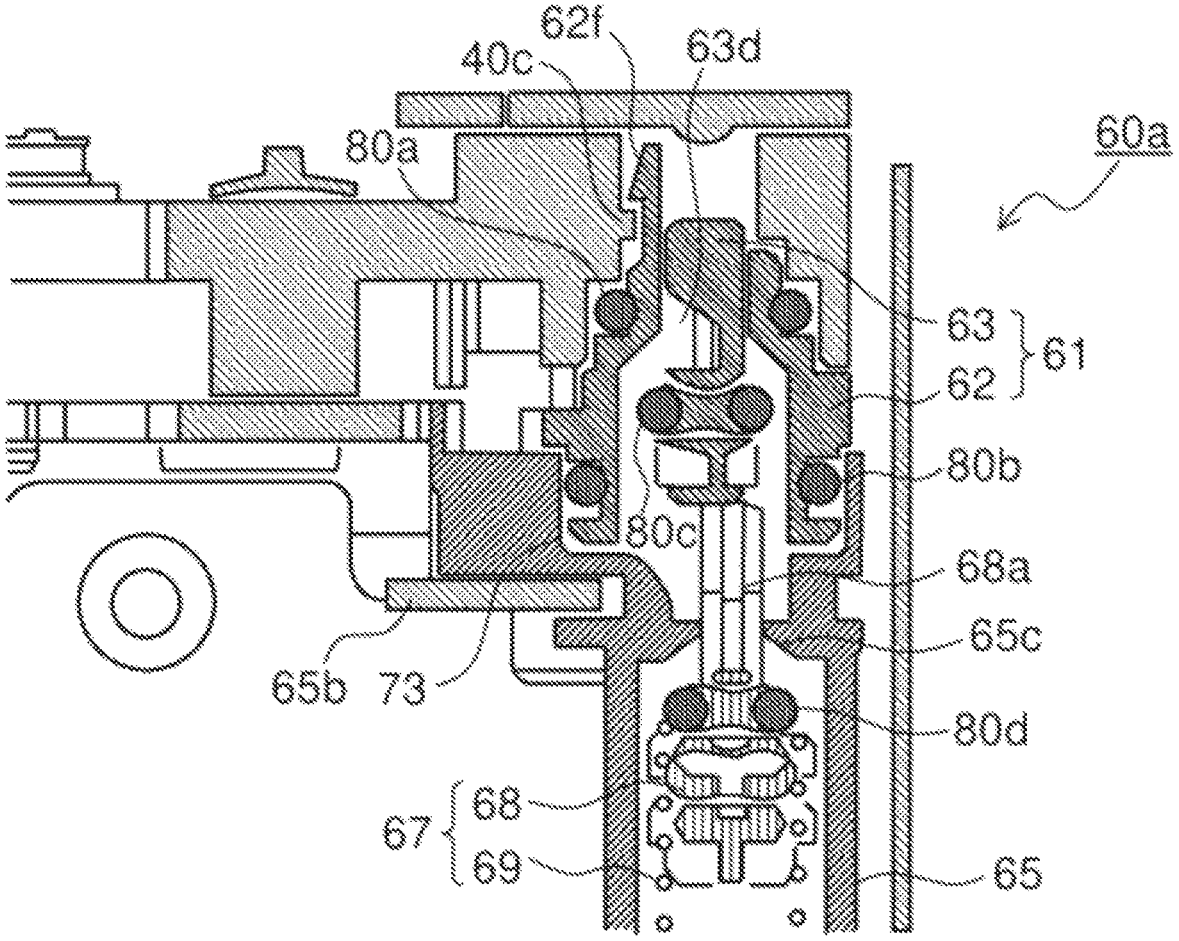
FIG. 15 is a side cross-sectional view of the joint mechanism 60*a*, showing a state in which the first on-off valve 61 and the second on-off valve 67 are opened.

Next, opening and closing operations of the first on-off valve 61 and the second on-off valve 67 will be described. FIGS. 14 and 15 are side cross-sectional views of the joint mechanism 60*a* and show a state in which the first on-off valve 61 and the second on-off valve 67 are closed and opened, respectively.

In the state shown in FIG. 14, the engagement boss 62*b* of the switching member 62 is positioned at the lower end portion of the engagement groove 63*d* of the first opening/closing member 63, and the third O-ring 80*c* attached to the first opening/closing member 63 is pressed against the inner surface of the insertion hole 62*a* of the switching member 62 to close the first on-off valve 61.

Further, in the state of FIG. 14 in which the first on-off valve 61 is in the closed state, the second opening/closing member 68 is pushed upward by the urging force of the coil spring 69. As a result, the fourth O-ring 80*d* attached to the second opening/closing member 68 is brought into pressure contact with the peripheral edge portion of the liquid passage port 65*c*, and the second on-off valve 67 is in a closed state.

When the first on-off valve 61 is opened, the lever portion 62*e* of the switching member 62 is pressed in the circumferential direction by the tip of a driver or the like from the state of FIG. 14, thereby rotating the switching member 62 in a predetermined direction (clockwise direction in FIG. 11). As a result, the engagement boss 62*b* of the switching member 62 moves from the lower end portion to the upper end portion in the engagement groove 63*d* of the first opening/closing member 63. Since the switching member 62 is fixed to the common flow path 40, the first opening/closing member 63 is moved downward by the movement of the engagement boss 62*b*. As a result, as shown in FIG. 15, the third O-ring 80*c* attached to the first opening/closing member 63 is separated from the inner surface of the insertion hole 62*a* of the switching member 62, and the first on-off valve 61 is opened.

Further, with the downward movement of the first opening/closing member 63, the second opening/closing member 68 abutting against the pressing portion 63*b* of the first opening/closing member 63 is pressed downward. As a result, the second opening/closing member 68 moves downward in the moving direction resisting against the biasing force of the coil spring 69. As a result, as shown in FIG. 15, the fourth O-ring 80*d* attached to the second opening/closing member 68 is separated from the peripheral edge portion of the liquid passage port 65*c* of the coupling member 65, and the second on-off valve 67 is also opened.

According to the above-described configuration, the second on-off valve 67 disposed on the coupling member 65 side (the recording heads 17*a* to 17*c* side) opens and closes following the opening and closing operation of the first on-off valve 61 disposed on the common flow path 40 side. That is, the first on-off valve 61 disposed on the common flow path 40 side and the second on-off valve 67 disposed on the coupling member 65 side (the recording heads 17*a* to 17*c* side) can be simultaneously opened and closed by one operation. This reduces the possibility of forgetting to close the first on-off valve 61 or the second on-off valve 67 when removing the recording heads 17*a* to 17*c* from the head unit 51, or forgetting to open the first on-off valve 61 or the second on-off valve 67 when mounting the recording heads 17*a* to 17*c* on the head unit 51.

Therefore, it is possible to suppress ink leakage or cleaning liquid leakage due to replacement of the recording heads 17*a* to 17*c* without closing the first on-off valve 61 or the second on-off valve 67. In addition, it is also possible to suppress the occurrence of a printing defect due to forgetting to open the first on-off valve 61 or the second on-off valve 67 after replacing the recording heads 17*a* to 17*c*.

Here, when the first on-off valve 61 and the second on-off valve 67 are closed, ink or cleaning liquid remains in the space between the first on-off valve 61 and the second on-off valve 67 (the space from the insertion hole 62*a* of the switching member 62 to the liquid passage port 65*c* of the coupling member 65). For this reason, even if the recording heads 17*a* to 17*c* are removed from the common flow path 40 in a state where the first on-off valve 61 and the second on-off valve 67 are closed, there is a concern that the ink or the cleaning liquid remaining between the first on-off valve 61 and the second on-off valve 67 may leak.

Therefore, in the present embodiment, the liquid storage portion 73 having a volume equal to or larger than the space between the first on-off valve 61 and the second on-off valve 67 is formed on the upper surface of the coupling member 65 constituting the joint mechanisms 60*a* to 60*c*. Accordingly, when the recording heads 17*a* to 17*c* are detached from the common flow path 40, the ink or the cleaning liquid remaining between the first on-off valve 61 and the second on-off valve 67 is stored in the liquid storage portion 73, and thus it is possible to suppress contamination in the printer 100 due to leakage of the ink or the cleaning liquid.

[3. Recording Head Attachment/Detachment Procedure]

Figure 16:
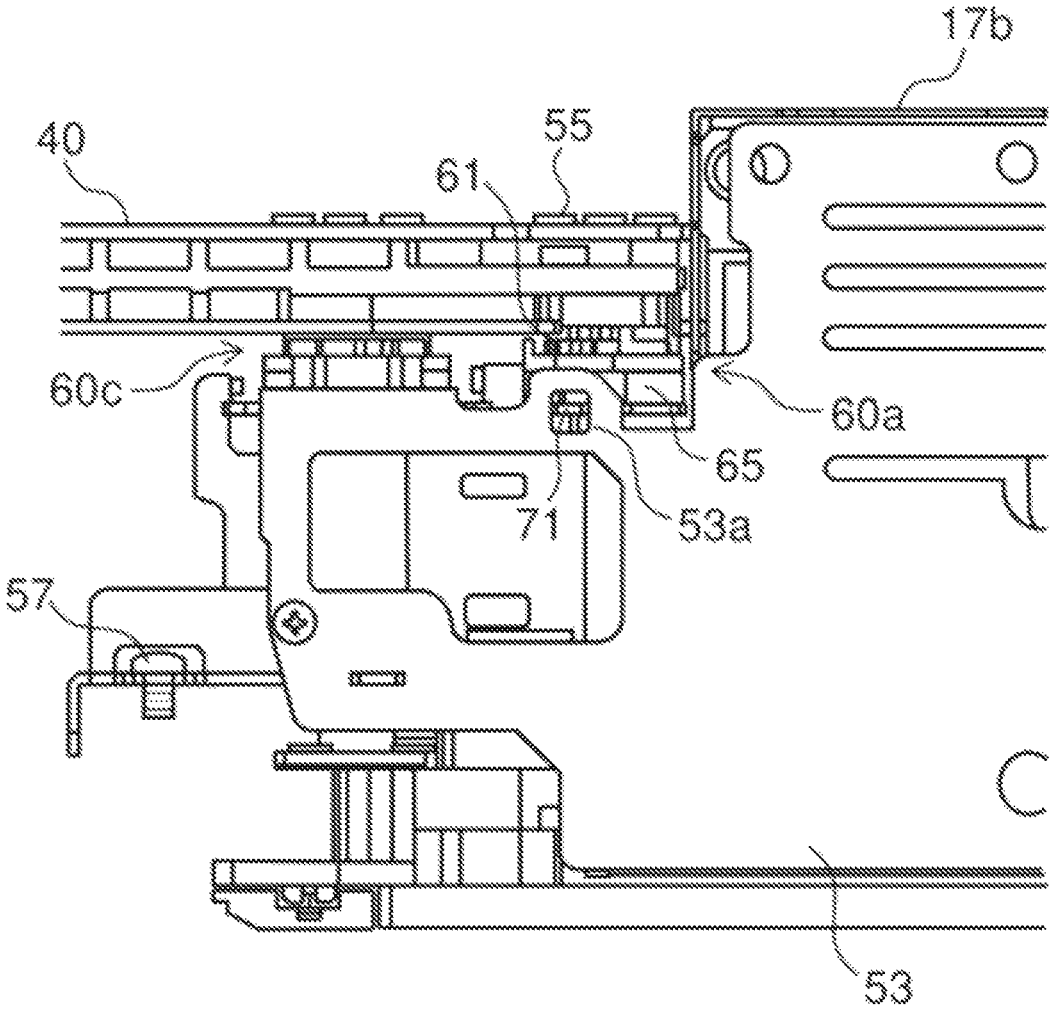
FIG. 16 shows an enlarged view of the vicinity of a joint mechanism 60*b* on a side surface of the recording head 17*b*, showing a state in which the joint mechanism 60*a* is connected.

Next, a procedure of attaching and detaching the recording heads 17*a* to 17*c* will be described. FIG. 16 is an enlarged view of the vicinity of the joint mechanism 60*a* on the side surface of the recording head 17*b*. Here, the attachment/detachment procedure of the recording head 17*b* will be described, but the same procedure is applied to the recording heads 17*a* and 17*c*.

When the recording head 17*b* is removed from the common flow path 40, first, the lever portion 62*e* of the switching member 62 is operated to close the first on-off valve 61 and the second on-off valve 67 as shown in FIG. 14. Next, the three first fixing screws 55 fastened to each of the three joint mechanisms 60*a* to 60*c* (i.e., nine first fixing screws 55, in total) are removed. When the first fixing screw 55 is removed, the coupling between the coupling member 65 and the common flow path 40 is released, so that the coupling member 65 is held at the coupling position only by the biasing force of the coil spring 69. The recording head 17*b* is fastened to the common flow path 40 by a second fixing screw 57.

Next, the protrusion 71 of the support plate 65*b* protruding from the opening 53*a* of the heat sink 53 is pressed down with a finger. As a result, the main body portion 65*a* to which the support plate 65*b* is fixed is also pushed down together with the support plate 65*b* resisting against the urging force of the coil spring 69. That is, the coupling member 65 moves from the coupling position to a position retracted downward (retracted position).

Figure 17:
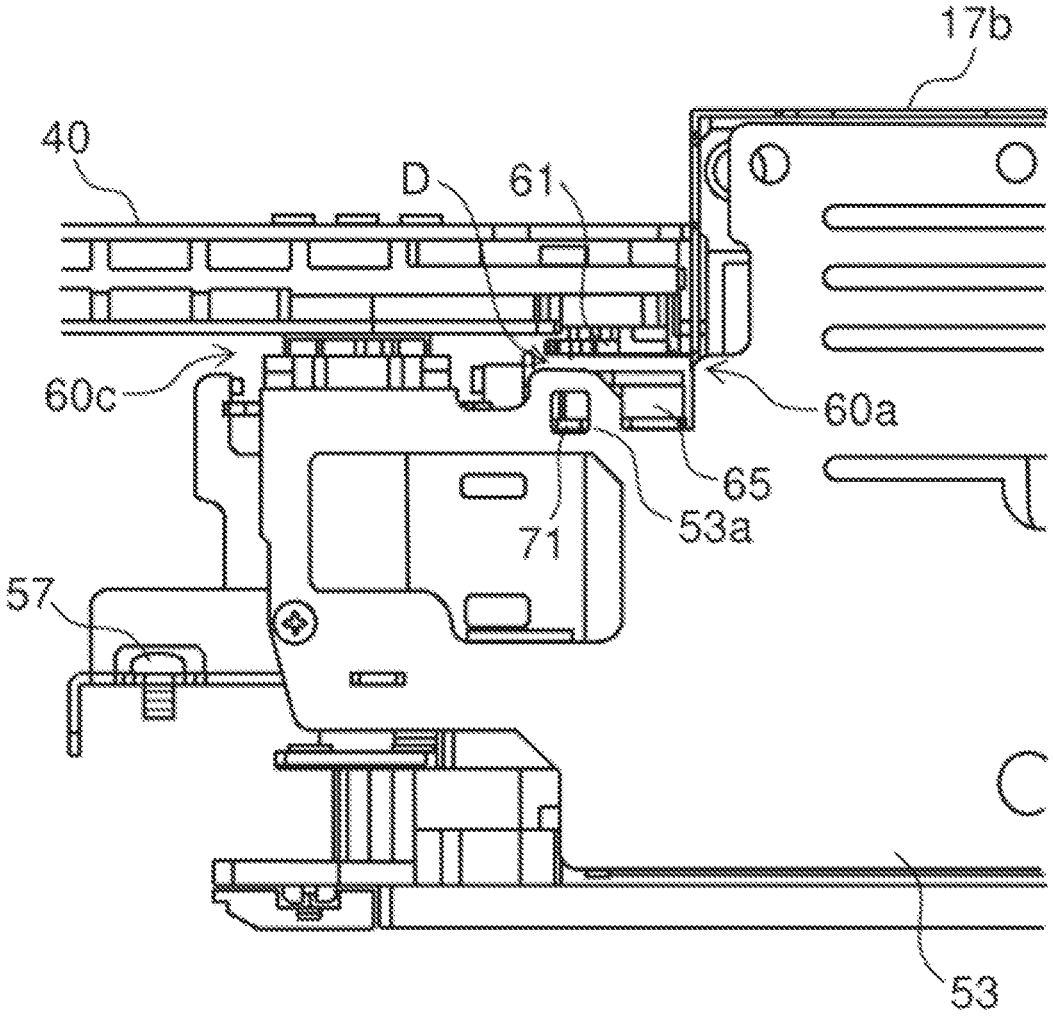
FIG. 17 shows an enlarged view of the vicinity of a joint mechanism 60*a* on a side surface of the recording head 17*b* and shows a state in which a coupling member 65 is moved to a retracted position from the state of FIG. 16.
Figure 18:
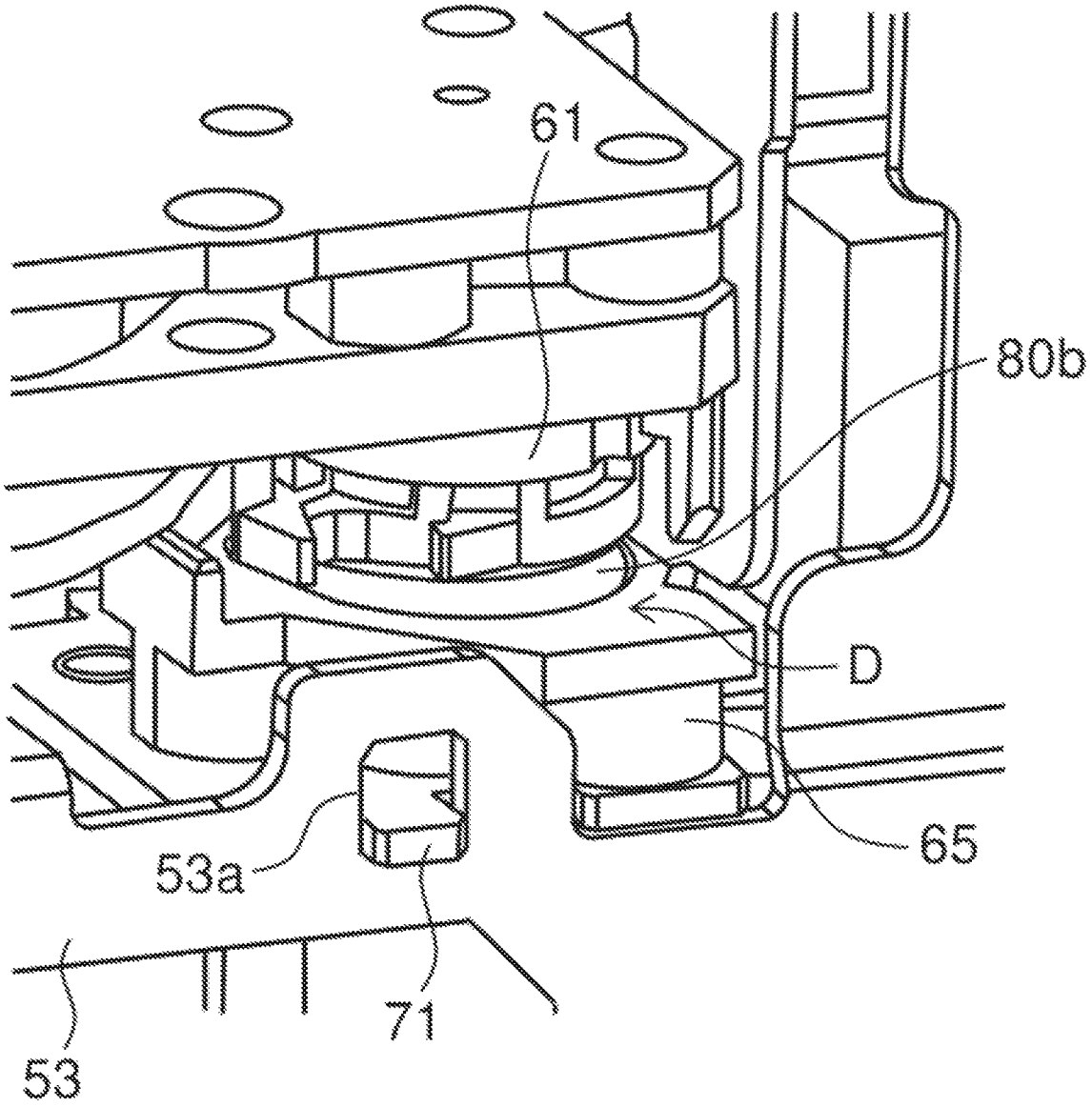
FIG. 18 is an enlarged perspective view of a clearance portion between the first on-off valve 61 and the coupling member 65 in FIG. 17.

FIG. 17 is a diagram illustrating a state in which the coupling member 65 is moved to the retracted position from the state of FIG. 16. FIG. 18 is an enlarged perspective view of a clearance portion between the first on-off valve 61 and the coupling member 65 in FIG. 17. As shown in FIGS. 17 and 18, as the coupling member 65 moves to the retracted position, a clearance D is formed between the first on-off valve 61 and the coupling member 65.

By inserting paper or cloth into the clearance D, ink or cleaning liquid remaining between the first on-off valve 61 and the coupling member 65 can be absorbed. Ink and cleaning that cannot be absorbed by paper or cloth are stored in the liquid storage portion 73. Thereafter, the second fixing screws 57 fastened to the left and right sides of the recording head 17*b* are removed, and the recording head 17*b* is removed from the common flow path 40.

When the recording head 17*b* is attached to the common flow path 40, the coupling member 65 is connected to each of the first on-off valves 61 of the three joint mechanisms 60*a* to 60*c* in a state where the first on-off valves 61 are closed. Then, the recording head 17*b* is attached to the common flow path 40 by fastening the first fixing screw 55 and the second fixing screw 57. Thereafter, the lever portion 62*e* of the switching member 62 of each joint mechanism 60*a* to 60*c* is operated to open the first on-off valve 61 and the second on-off valve 67, thereby enabling supply of ink and cleaning liquid to the recording head 17*b*.

By attaching and detaching the recording heads 17*a* to 17*c* according to the above-described procedure, leakage of ink and cleaning liquid from the joint mechanisms 60*a* to 60*c* can be effectively suppressed with a simple configuration and operation.

In addition, the present disclosure is not limited to the above-described embodiment, and various modifications can be made without departing from the spirit of the present disclosure. For example, in the above-described embodiment, a configuration in which three recording heads 17*a* to 17*c* are mounted in one head unit 51 has been described. However, for example, a configuration in which only one recording head is mounted in the head unit 51 or a configuration in which two or four or more recording heads are mounted may be employed.

In addition, in the above-described embodiment, each recording head 17*a* to 17*c* includes the joint mechanisms 60*a* and 60*b* for ink supply and the joint mechanism 60*c* for supplying cleaning liquid, but the number and arrangement of the joint mechanisms can be appropriately changed according to the configuration of the recording head or the like.

In addition, in the above-described embodiment, an example in which a color printer that records a color image using four colors of ink is used as the inkjet recording apparatus has been described. However, the ink discharge path according to the present embodiment can also be applied to a monochrome printer which records a monochrome image using a black ink.

The present disclosure can be applied to an inkjet recording apparatus such as an inkjet printer including a detachable recording head.

What is claimed is:

1. A head unit comprising;

a common flow path having a liquid supply path through which one or more types of liquid including ink pass;

one or more recording heads that are attachable to and detachable from the common flow path and have nozzles that discharge the ink; and a joint mechanism that connects the liquid supply path and a liquid supply port of the recording head, wherein the head unit is mounted on an inkjet recording apparatus and performs image recording on a recording medium, wherein the joint mechanism includes;

a first on-off valve that is fixed to the common flow path and opens and closes the liquid supply path; and a coupling member that couples the first on-off valve and the liquid supply port, and wherein the coupling member is movable between a coupling position where the coupling member is coupled to the first on-off valve and a retracted position where the coupling member is retracted from the coupling position, and when the coupling member is positioned in the retracted position, a clearance is formed between the first on-off valve and the coupling member.

2. The head unit according to claim 1, further comprising;

a first fixing screw fixing the coupling member to the common flow path; and a second fixing screw fixing the recording head to the common flow path, wherein by removing the first fixing screw in a state where the second fixing screw is fastened, only the coupling member can be moved to the coupling position and the retracted position in a state where the recording head is fixed to the common flow path.

3. The head unit according to claim 1, wherein the first on-off valve includes a switching member having an insertion hole and an engagement boss protruding from an inner peripheral surface of the insertion hole;

a first opening/closing member including a sliding portion that is inserted into the insertion hole so as to be vertically slidable, and an engagement groove that is formed so as to be inclined with respect to an axial direction of the sliding portion and with which the engagement boss is engaged; and a first sealing member attached to the first opening/closing member and in contact with or separated from the inner peripheral surface of the insertion hole, and wherein by rotating the switching member to move the first opening/closing member up and down, the first on-off valve is switched between a closed state in which the first sealing member is in contact with the inner peripheral surface of the insertion hole and a closed state in which the first sealing member is separated from the inner peripheral surface of the insertion hole.

4. The head unit according to claim 3, wherein the joint mechanism includes a second on-off valve provided inside the coupling member, and the second on-off valve opens and closes following an opening and closing operation of the first on-off valve.

5. The head unit according to claim 4, wherein the second on-off valve includes;

a second opening/closing member that protrudes from the liquid passage port of the coupling member and comes into contact with the first opening/closing member;

a biasing member that biases the second opening/closing member in a direction approaching the first opening/closing member; and a second sealing member attached to the second opening/closing member and contacting with or separate from a peripheral edge portion of the liquid passage port, and wherein by rotating the switching member to move the first opening/closing member up and down, the second on-off valve is switched between a closed state in which the second sealing member is in contact with the peripheral edge portion of the liquid passage port and a closed state in which the second sealing member is separated from the peripheral edge portion of the liquid passage port.

6. The head unit according to claim 3, wherein the switching member includes a lever portion that is operated when the switching member is rotated.

7. The head unit according to claim 3, wherein the switching member includes an engaging claw that engages with an engaged portion of the common flow path.

8. An inkjet recording apparatus comprising;

the head unit according to claim 1, and a liquid supply mechanism that supplies the liquid to the head unit.

* * * * *